US005232533A

United States Patent [19]

Tani et al.

[11] Patent Number: 5,232,533

[45] Date of Patent: Aug. 3, 1993

[54] METHOD FOR HEAT-SETTING CROSS-LAMINATED NON-WOVEN FABRICS

[75] Inventors: Haruhisa Tani, Tokorozawa; Kazuhiko Kurihara; Hiroshi Yazawa, both of Tokyo; Toshikazu Ohishi, Kawaguchi, all of Japan

[73] Assignees: Nippon Petrochemicals Co., Ltd.; Polymer Processing Research Institute, Ltd., both of Tokyo, Japan

[21] Appl. No.: 682,987

[22] Filed: Apr. 10, 1991

Related U.S. Application Data

[63] Continuation-in-part of Ser. No. 302,626, Jan. 26, 1989, abandoned.

[51] Int. Cl.[5] ..... B32B 5/00

[52] U.S. Cl. ..... 156/181; 156/324; 156/177; 156/178

[58] Field of Search ..... 156/62.8, 163, 164, 156/181, 229, 302, 324, 265, 583.5, 266, 161, 177, 178, 496; 428/284, 294, 298; 425/373

[56] References Cited

U.S. PATENT DOCUMENTS

| | | | |
|---|---|---|---|
| 2,483,404 | 10/1949 | Francis, Jr. | 156/62.6 X |
| 3,250,655 | 5/1966 | Adler | 156/265 X |
| 3,519,509 | 7/1970 | Gidge et al. | 156/441 X |
| 3,616,037 | 10/1971 | Burger | 156/177 |
| 3,669,795 | 6/1972 | Yazawa et al. | 156/265 |
| 3,723,235 | 3/1973 | Armstrong | 156/181 X |
| 3,734,812 | 5/1973 | Yazawa | 156/177 X |
| 3,853,662 | 12/1974 | Yazawa et al. | 156/265 |
| 3,859,156 | 1/1975 | Yazawa et al. | 156/265 |
| 3,912,432 | 10/1975 | Fleissner | 425/373 |
| 4,052,243 | 10/1977 | Yazawa et al. | 156/265 |
| 4,211,807 | 7/1980 | Yazawa et al. | 156/178 X |
| 4,256,522 | 3/1981 | Britton | 156/178 |
| 4,883,551 | 11/1989 | Britton | 156/178 |
| 4,992,124 | 2/1991 | Kurihara | 156/177 |

FOREIGN PATENT DOCUMENTS

| | | | |
|---|---|---|---|
| 64-45858 | 2/1989 | Japan | 156/178 |

*Primary Examiner*—Jeff H. Aftergut
*Attorney, Agent, or Firm*—Bucknam and Archer

[57] ABSTRACT

In a method of and an apparatus for heat-setting a non-woven fabric in which a warp web and a weft web is cross-laminated, the fabric is gripped at least at its opposite side edges by and between an outer peripheral surface of a hot cylinder and an endless belt normally tensioned against that outer peripheral surface. Widthwise shrinkage is fully prevented during travel of the fabric around the hot cylinder, and firm bonding of the warp and weft webs is attained.

7 Claims, 7 Drawing Sheets

METHOD FOR HEAT-SETTING CROSS-LAMINATED NON-WOVEN FABRICS

CROSS REFERENCE TO RELATED APPLICATION

This is a continuation-in-part of application Ser. No. 302,626 filed Jan. 26, 1989, now abandoned.

BACKGROUND OF THE INVENTION

1. Field of the Invention

This invention relates generally to the formation of cross-laminated non-woven fabrics and more particularly to a method of and an apparatus for heat-setting such a fabric without involving widthwise shrinkage.

By the term "cross-laminated non-woven fabric" used herein is meant a fabric resulting from crosswise lamination of a warp web and a weft web and tending to shrink upon exposure to heat particularly in the transverse direction. The term "heat setting" denotes a process step which allows for bonding of the above laminate into an integral structure while preventing the weft web from becoming widthwise shrunk and also for annealing the laminate to alleviate shrinkage of the weft web in the transverse direction.

2. Description of the Prior Art

Fabrics of a cross-laminated non-woven structure and sheets of a cross-laminated type have of late been developed and marketed. In the manufacture of such products, their respective warp and weft webs are superimposed one on the other and thereafter required to be successively set with heat without objectionable shrinkage caused widthwise relative to the line of production or to the direction of movement.

Both woven and nonwoven types of fabrics need to be heat-set to reduce heat shrinkability. A cross-laminated non-woven fabric, however, should be by nature subject to heat setting under relatively strict conditions as it is liable to shrink widthwise to a larger degree than a nonwoven fabric and hence responsible for unsightly appearance. Further, the fabric in question calls for firm bonding of the warp and weft webs at a high level and economical and efficient means for heat setting even in a speedier line of production.

A tentering system is known for use in the heat setting of a sheet-like product such as for example a stretched film or reticulate material. This treatment is done usually with two opposite sides of the sheet engaged with pins or clips. Although capable of heat-setting the sheet free from widthwise shrinkage, the system of tentering is undesirable for commercial application because, due to heating being dependent on hot air, it is rather bulky and spacious and hence feasible costly and moreover thermally inefficient. In the case of a non-woven fabric in which warp and weft webs are cross-laminated, firm bonding of both webs is made difficult to achieve with the above mode of heat setting.

To produce a cloth-like material by cross-laminating warp and weft webs, it has been proposed to effect fixation or otherwise adhesion on a hot rotating cylinder as disclosed for instance in U. S. Pat. No. 4,052,243. In this prior arrangement a continuous row of weft webs each severed to a length equivalent to the width of a warp web to be laminated is crosswise laid over or even beneath the latter web continuously fed to travel in the longitudinal direction. The resulting laminate is dried and fixed as it is successively guided around a rotating cylinder heated. Such arrangement is contrieved to attain improved efficiency of operation from crosswise lamination of the warp and weft webs to subsequent drying and adhesion. There is no suggestion in the above patent to cope with widthwise shrinkage which may occur during heat setting of highly oriented cross-laminated non-woven fabrics. No means in fact is provided for that purpose.

SUMMARY OF THE INVENTION

With the foregoing drawbacks of the prior art in view, the present invention seeks to provide a method of heat-setting a cross-laminated non-woven fabric on a hot cylinder which is highly capable of preventing the fabric from becoming shrunk widthwise during travel around the cylinder, thus ensuring strong bonding of the warp and weft webs. The invention further seeks to provide an apparatus for reducing such method to practice which is simple in construction, saving in space and great in thermal efficiency.

The cross-laminated non-woven fabric product according to the invention is highly aesthetic, mechanically strong as in tensile strength and Young's modulus and dimensionally wide.

Many other advantages of the invention will be better understood from the following description taken in conjunction with the accompanying drawings in which certain preferred embodiments of the invention are shown by way of example.

In one aspect the invention provides a method of heat-setting non-woven fabrics in which a warp web and a weft web are cross-laminated, the weft web being shrinkable at least transversely upon exposure to heat, which method comprises feeding a non-woven fabric having cross-laminated a warp web and a weft web onto a hot rotating cylinder via an endless belt, holding the warp and weft webs peripherally continuously on the hot cylinder, and gripping the non-woven fabric at least at its two opposite side edges by and between an outer peripheral surface of the hot cylinder and the endless belt normally tensioned against the outer peripheral surface of the hot cylinder, whereby the warp and weft webs held in laminated relation are bonded together into an integral structure free from widthwise shrinkage as they are passed around the hot cylinder.

Another aspect of the invention provides an apparatus for heat-setting non-woven fabrics in which a warp web and a weft web are cross-laminated, the weft web being shrinkable at least transversely upon exposure to heat, which apparatus comprises a hot rotating cylinder and an endless belt cooperating therewith in gripping a non-woven fabric having cross-laminated a warp web and a weft web, the endless belt being normally tensioned against an outer peripheral surface of the hot cylinder, whereby the warp and weft webs held in laminated relation are bonded together into an integral structure free from widthwise shrinkage as they are passed around the hot cylinder.

DETAILED DESCRIPTION OF THE INVENTION

Figure 1:
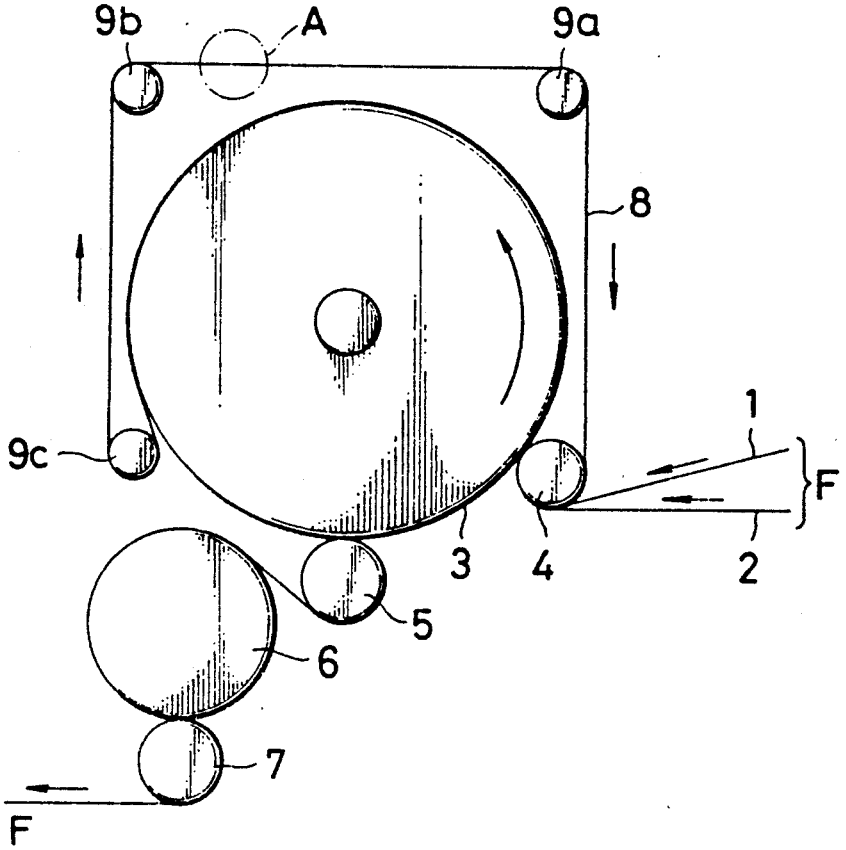
FIG. 1 is a diagrammatical view of the apparatus provided in accordance with the present invention.

The apparatus according to the present invention, as shown in an overall arrangement in FIG. 1, is constructed to heat-set a non-woven fabric F having cross-laminated a warp web 1 and a weft web 2. To this end the apparatus comprises a hot cylinder 3 regulated at a predetermined temperature and driven rotatably by a motor not shown. The non-woven fabric F in which the warp and weft webs 1, 2 have been laminated is successively fed and passed around the hot cylinder 3 cooperatively associated with an endless belt or belts 8, 8 in a manner to be mentioned.

The apparatus of the invention further includes first and second pinch or nip rolls 4, 5 held in rotable contact with the hot cylinder 3 and spaced centrally axially from each other usually at an about 60 degrees with respect to the central axis of the hot cylinder 3 so that the non-woven fabric F is guided along and by about five-sixths of the overall circumference of the hot cylinder 3. The warp and weft webs 1, 2 are cross-laminated as they are fed onto and along the first nip roll 4 and thereafter heat-set while in travel around the hot cylinder 3. Disposed downstream of the second nip roll 5 is a cylinder 6 for cooling the fabric F heat-set on the hot cylinder 3 and conveyed from the second nip roll 5. An ultimate fabric product of a cross-laminated non-woven structure is withdrawn from a third pinch or nip roll 7 located to hold the fabric F in intimate contact with the cooling cylinder 6.

Figure 2:
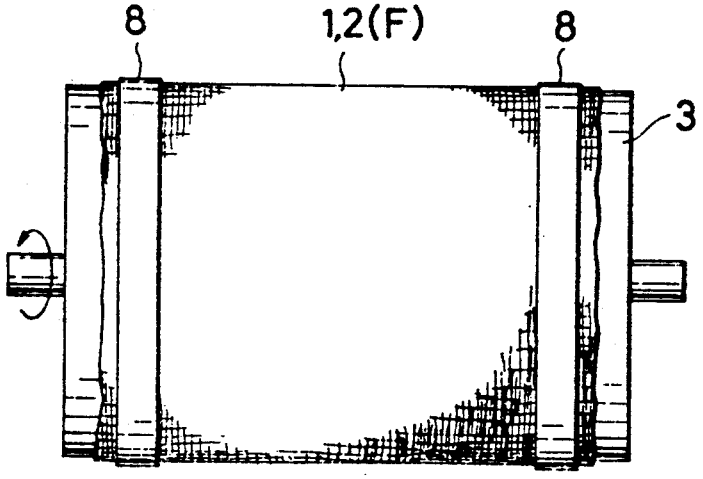
FIG. 2 is a schematic plan view of a hot rotating cylinder and a cooperating pair of endless belts assembled in the apparatus of FIG. 1.

To prevent widthwise shrinkage during heat setting, the non-woven fabric F should importantly be traveled with at least its two opposite side edges being gripped by and between an outer peripheral surface of the hot cylinder 3 and the endless belt 8. In a first embodiment of the apparatus according to the invention, the endless belt 8 is disposed in pair and spaced in parallel as seen in FIG. 2. The paired belts 8, 8 are allowed to run around the first nip roll 4 and first, second and third guide rolls 9*a*, 9*b*, 9*c* so as to be normally tensioned against the outer peripheral surface of the hot cylinder 3. This tensioning has an important role to render the fabric F widthwise shrink-proof during travel over the hot cylinder 3. The third guide roll 9*c* is positioned upstream of the second nip roll 5 and spaced circumferentially at an angle of about 60 degrees from the nip roll 5 with the result that the endless belts 8, 8 are caused to guide about half of a preceding portion of the fabric F retained on the hot cylinder 3. The endless belts 8, 8 may be arranged, where desired, to further extend around the second nip roll 5 in which instance they are positioned to coextend with the side edges of the fabric F.

Figure 3:
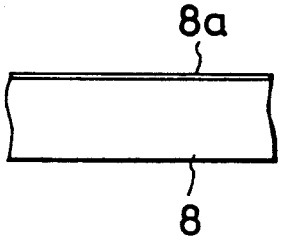
FIG. 3 is a side view, partly enlarged, of one of the endless belts seen at from the circle A in FIG. 1.

Each of the endless belts 8, 8 is made of a heat-resistant material sufficient to withstand a temperature at which the cylinder 3 is heated in operation. As shown in FIG. 3, the belts 8, 8 may preferably be release-treated on one surfac with use of a release layer 8*a* which is held in face-to-face relation to the outer surface of the non-woven fabric F. The release layer 8*a* may by suitable choice be for example a fluorine resin film and a silicone resin film.

Figure 4:
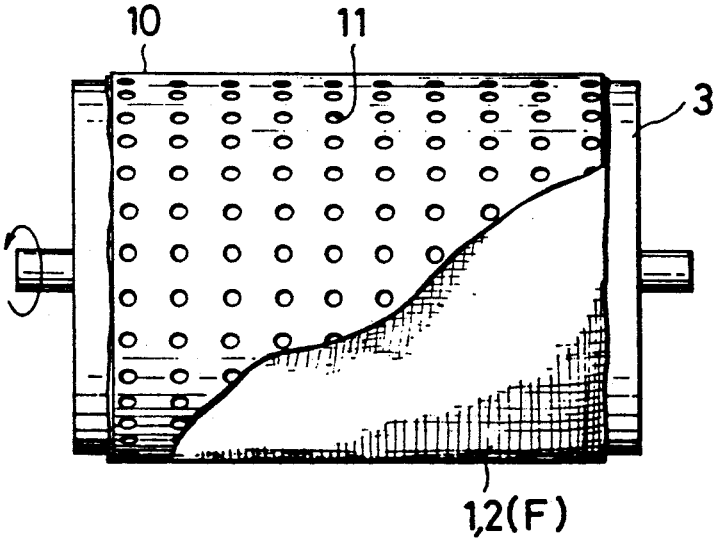
FIG. 4 is a view similar to FIG. 2 but showing another embodiment of the invention in which a single endless belt is disposed.

A second embodiment of the apparatus illustrated in FIG. 4 is so structured as to grip the fabric F substantially throughout its overall width by and between the hot cylinder 3 and a single endless belt 10. Other arrangements may be made substantially identical to those noted in connection with the first embodiment shown in FIGS. 1 and 2. The endless belt 10 is generally of the same width as the fabric F and has a multiplicity of pores or perforations 11 uniformly distributed over the outer surface. The perforated belt 10 serves to remove moisture which may generate from either one or both of the warp and weft webs 1, 2 in the fabric F while in heat setting during travel on the hot cylinder 3, thus preventing the fabric F against shrinkage owing to the vapor.

In FIG. 2 similar endless belts may be further disposed in spaced relation so as to hold the fabric F throughout the overall width. In any case the fabric F is gripped at its two opposite ends to thereby prevent shrinkage in the transverse direction.

Figure 5A:
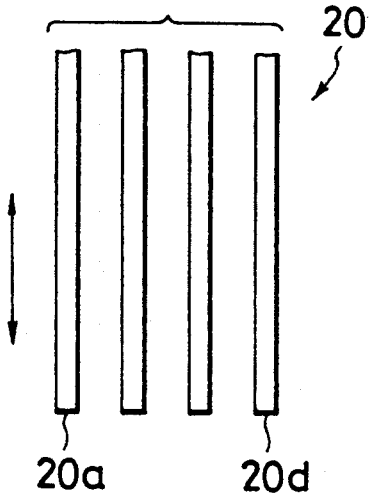
FIGS. 5A to 5E are segmental plan views of several forms of warp webs according to the invention.
Figure 5B:
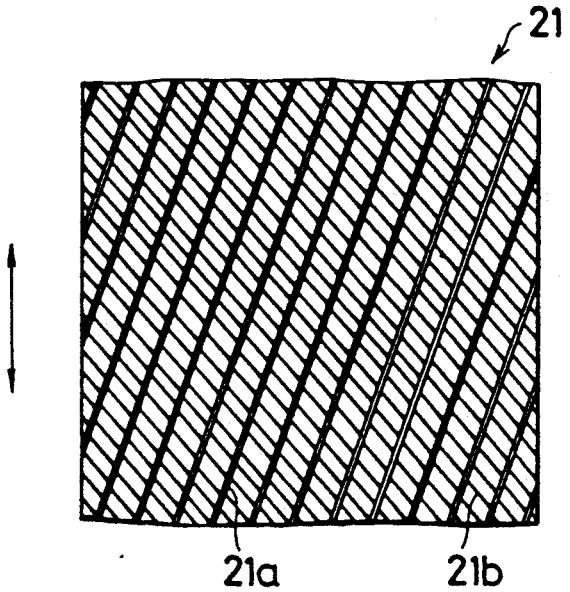
Figure 5C:
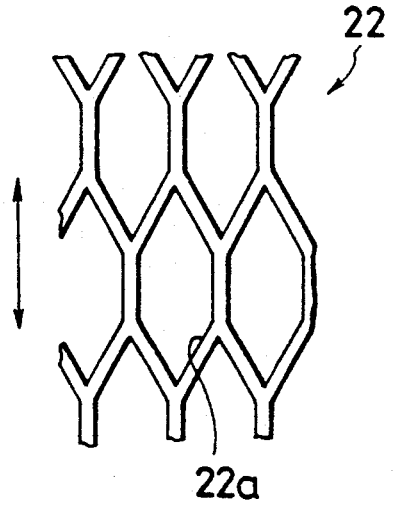
Figure 5D:
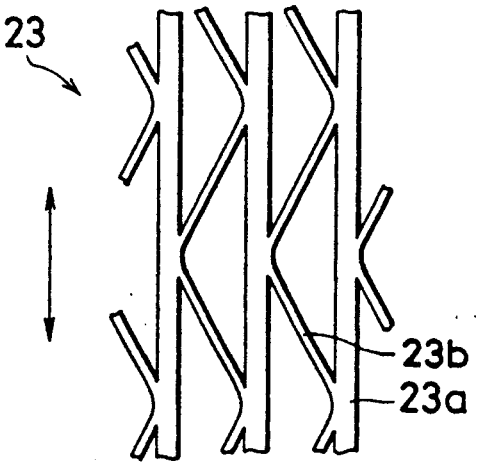
Figure 5E:
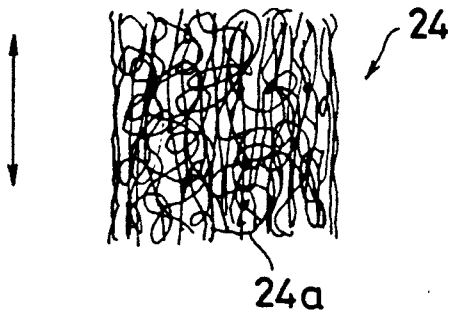

Suitable warp webs designated generally at 1 and used for purposes of the invention are selected typically from a split web widthwise spread 1.1 to 5.0 times the original width, a reticulate web formed of trunk and branch filaments, a slit reticulate web formed of wide width stretched film or a longitudinally stretched non-woven fabrics. These warp webs may be used singly or in combination. The warp web 1 is of a type carrying no selvages and having a greater strength in the longitudinal direction than transversely and a certain degree of bondability. It may be pretreated with a suitable adhesive. More specifically, FIG. 5A is taken to represent a warp web 20 in which stretched tapes 20*a*, 20*d*, four tapes shown, are arranged in parallel juxtaposition in the lengthwise direction. Yarns may be substituted for the tapes 20*a*, 20*d*. FIG. 5B shows a warp web 21 having reticulated a multiplicity of trunk filaments 21*a* and branch filaments 21*b*. A warp web 22 illustrated in FIG. 5C is formed of a plurality of hexagonal filaments 22*a*. A warp web 23 is composed of straight thick filaments 23*a* and branched thin filaments 23*b* as seen in FIG. 5D. Illustrated in FIG. 5E is a warp web 24 made up of a plurality of longitudinally stretched filaments 24*a*, namely a randomed non-woven fabric generated by spun bonding or melt blowing. The warp webs 21, 22, 23 in reticular form are obtained by longitudinally sliting a longitudinally stretched tape.

Figure 6A:
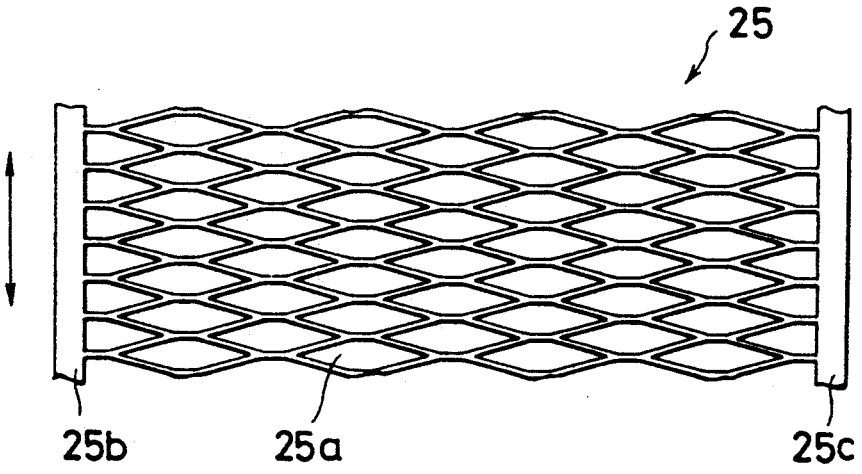
FIGS. 6A to 6C are views similar to FIGS. 5A to 5E but showing forms of weft webs according to the invention.
Figure 6B:
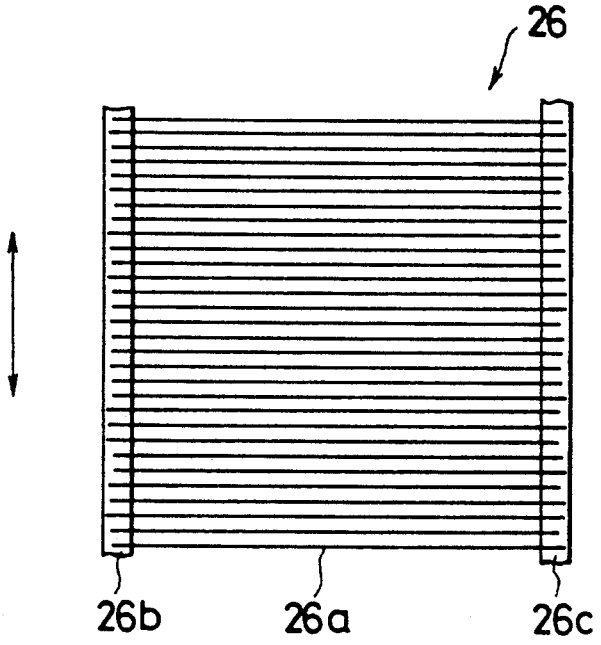
Figure 6C:
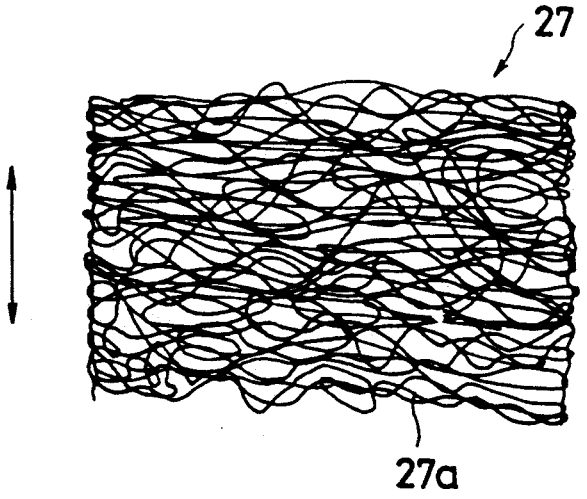

Typical examples of eligible weft webs 2 include a web formed by conveying weft web segments laterally over the warp web in the machine direction and overlaid onto the warp web in side by side relationship and without any gaps left between each other, after being severed to the length corresponding to the width of the warp web, a transversely stretched web of parallel-laid weft fibers either alone or in combination. The weft web 2 is stronger transversely than longitudinally and shrinkable particularly widthwise upon application of heat. It is not selvaged or selvaged along two marginal edges and in the direction of travel and may be treated with an adhesive as in the warp web 1. FIG. 6A illustrates a weft web 25 resulting from formation of transverse cuts in a film to thereby define reticular portions 25*a* and from subsequent transverse stretching. The weft web 25 has on both sides selvages 25*b*, 25*c* which serve as gripper aids in transverse stretch as by a tenter. This type of weft web is taught in U.S. Pat. Nos. 4,359,500 and 4,525,317. The reticular portions 25*a* may if necessary be replaced by one of the warp webs 20, 21, 23 shown in FIGS. 5A, 5B and 5D but arranged in a transverse posture. A weft web 26 appearing in FIG. 6B has a plurality of centrifugally spun, transversely stretched filaments 26*a* and two selvages 26*b*, 26*c*. Such a weft web is disclosed in U.S. Pat. No. 4,440,700. Seen in FIG. 6C is a weft web 27 formed of a multiplicity of transversely stretched filaments 27*a* and chosen for example from randomed non-woven fabrics spunbonded or melt-blown.

The warp and weft webs according to the invention may be comprised of an upper layer, a lower layer and a core interposed therebetween. In this instance the core preferably has a higher melting or softening point than the two layers.

To bond the warp and weft webs 1, 2, either one or both of the two webs are usually treated with a suitable adhesive. This may be done for example by coextrusion or lamination of a polymer of a lower softening or melting point than that used to constitute the fabric F, coating with a hot melt adhesive or dipping in a solution adhesive. Upon application of heat the thus treated webs tend to shrink, leading adverse interfacial deviation and insufficient adhesion strength. Taking this problem in view, the invention contemplates formation of a cross-laminated non-woven fabric of improved adhesion strength without widthwise shrinkage of the weft web.

Figure 9:
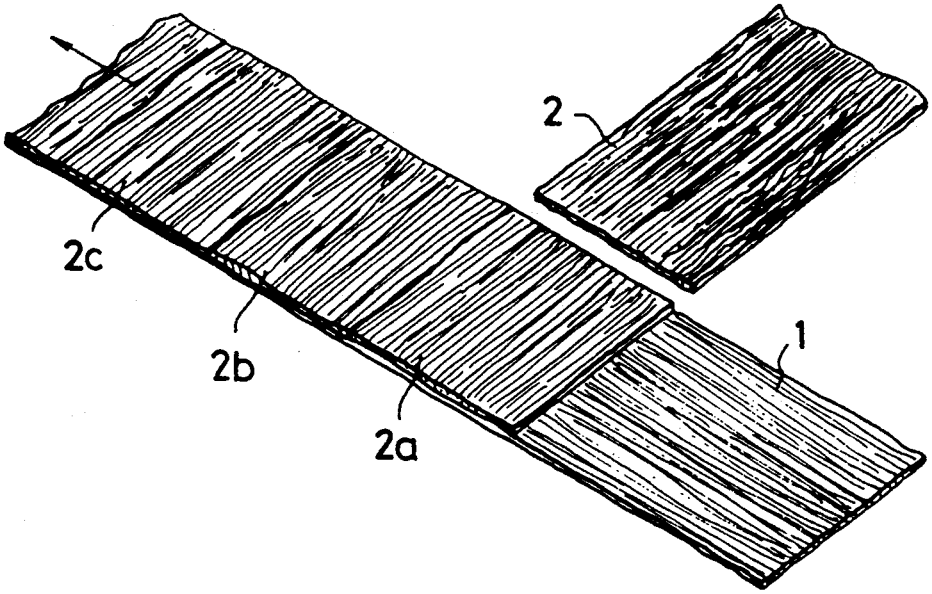
FIG. 9 is a perspective view showing the manner in which a continuous warp web is crosswise laminated with unselvaged weft webs not selvaged.

In FIG. 9 there is represented the manner in which a continuous warp web 1 not selvaged is laminated with a row of weft webs 2*a*, 2*b*, 2*c* not selvaged. The warp web 1 is of a longitudinally stretched structure made up of inner and outer layers of a lower softening or melting point and a core of a higher similar point interposed therebetween. The weft webs 2*a* to 2*c* have a length corresponding to the width of the warp web. Lamination is crosswise made such that the weft webs are substantially butted at their side edges against the side edges of the warp web. The resultant laminate is conveyed onto a hot cylinder 3 with the weft webs supported on the warp web, thereby heat-setting the warp and weft webs with strong bonding.

Figure 10:
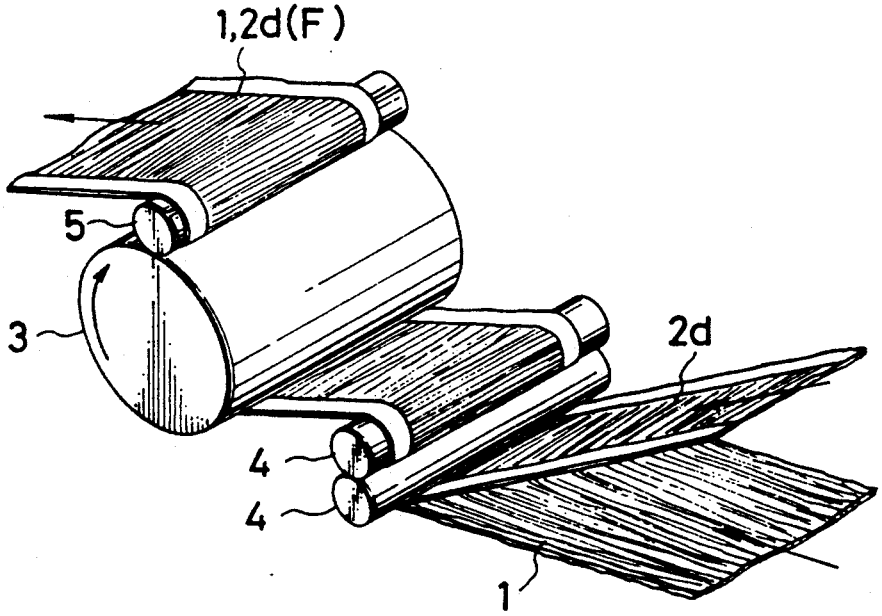
FIG. 10 is a perspective view showing the manner in which a warp web and a row of selvaged weft webs are being traveled together into a laminated structure.

A row of selvaged weft webs 2*d* is crosswise laminated, as seen in FIG. 10, with a continuously traveling warp web 1 and fed onto a hot cylinder 3.

The fabrics thus obtained when shrunk widthwise during heat setting are subjected to objectionable shifting and interfacial deviation and hence unsightly appearance and poor adhesion strength. The warp web is likely to shrink only to a negligible degree as against the weft web because the former web is normally tensioned to be traveled in the longitudinal direction.

In operation, a given warp web 1 and a given weft web 2 are cross-laminated into a non-woven fabric F as both webs are successively fed around the first nip roll 4. The fabric F is subsequently allowed to travel onto the hot cylinder 3. During the travel the fabric F is peripherally continuously held on the hot cylinder 3 and firmly gripped at its opposite side edges by and between the outer peripheral surface of the hot cylinder 3 and the endless belts 8, 8 normally tensioned against that outer peripheral surface. Thus the fabric F is heat-set into an integral structure immune from shrinkage in the transverse direction. The fabric F is withdrawn via the second nip roll 5 from the hot cylinder 3 and then conveyed around the cooling cylinder 6 from which a cross-laminated non-woven fabric product is drawn by means of the third nip roll 7.

Transverse stretching of non-woven fabrics for use as the weft webs 2 in the invention will now be described with reference to FIGS. 7 and 8.

Figure 7:
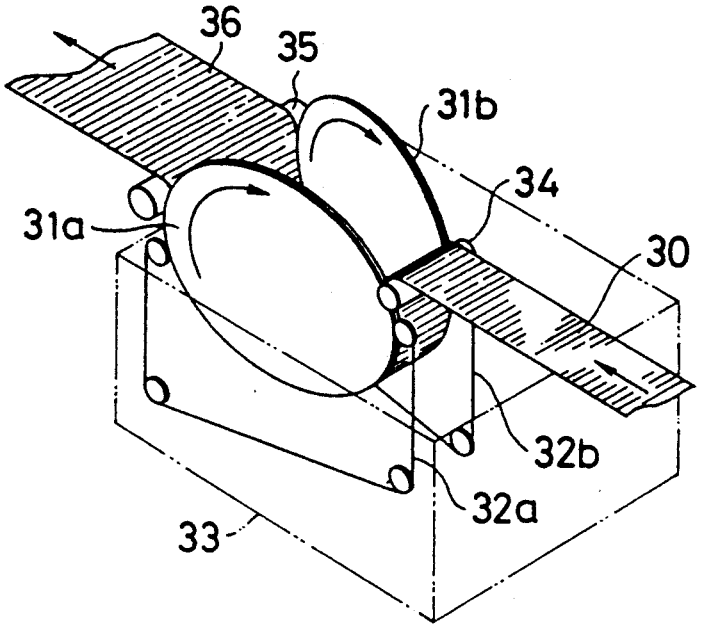
FIG. 7 is a perspective view of a pulley type device used to transversely orient a weft material into either one weft web according to the invention.

A device shown in FIG. 7 comprises a pair of laterally spaced pulleys 31*a*, 31*b* rotating at the same peripheral speed and disposed in symmetry with respect to the direction of movement of a non-woven fabric material 30, thereby defining two divergent arcuate paths on and along their outer peripheral edges, and a pair of endless belts 32*a*, 32*b* trained under tension around lower parts of the peripheral edges of the pulleys 31*a*, 31*b*. The lower parts of the pulleys 31*a*, 31*b* are received in a chamber 33 for heating the fabric 30 as it is traveled around both pulleys.

The non-woven fabric 30, fed longitudinally by the pulleys 31*a*, 31*b* via a first run roll 34, is gripped at its opposite side edges by and between the pulleys 31*a*, 31*b* and the corresponding endless belts 32*a*, 32*b* and thereafter stretched transversely as those side edges are moved along the two divergent arcuate paths. This stretching causes the individual filaments in the fabric 30 to undergo molecular orientation in the transverse direction. The fabric 30 is heated during stretching by a medium such as hot water or hot air or by an infrared heater in the heating chamber 33. In the case where hot air is employed, the medium is forcibly penetrated through the fabric 30 so as to increase thermal efficiency. Via a second turn roll 35 a transversely stretched weft web 36 is withdrawn in which selvages are provided on both sides as seen for example from the weft web 25 in FIG. 6A and the weft web 26 in FIG. 6B.

Figure 8:
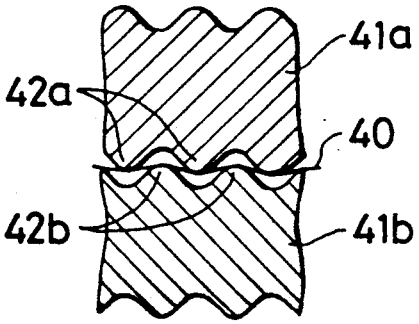
FIG. 8 is a cross-sectional view of a pair of grooved rolls assembled in another device for transversely orienting a weft material into either one weft web according to the invention.

FIG. 8 shows a device including a cooperating pair of grooved rolls 41*a*, 41*b* each having at both surfaces a plurality of parallel spaced teeth 42*a*, 42*b* held in meshed relation to one another for transversely stretching a non-woven fabric 40 as the latter is squeezed between the rolls 41*a*, 41*b*. The fabric 40 after being stretched is tentered and passed through at least one pair of similar grooved rolls not shown. This multistage transverse stretching results in a non-woven fabric carrying no selvages and having a high stretch magnitude and a uniform structure. In the case of use of the grooved rolls 41*a*, 41*b*, stretching takes place at each of transversely juxtaposed narrow areas extending between the teeth 42*a*, 42*b* on the rolls 41*a*, 41*b*. Such mode of subdivisional stretch compensates for irregularities in thickness of the fabric 40 and also for those in bonding or otherwise interlacing of the individual filaments. Though not shown, the rolls 41*a*, 41*b* may be made groove-free at their opposite end portions so that the fabric 40 is firmly gripped at its side edges while in stretching. Alternatively, the side edges of the fabric 40 may be gripped by and between the rolls 41*a*, 41*b* and a pair of endless belts trained around two opposite ends of both rolls.

The invention has the following beneficial effects.

1. Dimensionally wide fabric product due to freedom from widthwise shrinkage.

2. Aesthetic product with the weft web filaments regularly disposed and tensioned owing to compression (most important requirement in a cross-laminated non-woven type of fabric).

3. Firm bonding of the warp and weft webs. Strongly bonded product.

4. Mechanically strong product with transverse tensile strength increased and with Young's modulus improved.

5. Great cost saving owing to the use of simple apparatus.

6. Good thermal efficiency and speedy production attributable to direct contact of the fabric with the outer surface of the cylinder.

What is claimed is:

1. A method of heat-setting a non-woven fabric in which a warp web and a weft web are cross-laminated, said weft web being shrinkable at least transversely upon exposure to heat, said weft web being selvaged along the opposite marginal edges thereof, which method comprises feeding a non-woven fabric having cross-laminated a warp web and a weft web onto a hot rotating cylinder via a pair of endless belts spaced in parallel with each other, holding said warp and weft webs peripherally continuously on said hot cylinder, and gripping said warp web at least at its two opposite side edges and said weft web at the two opposite selvages thereof, by and between an outer peripheral surface of said hot cylinder and said endless belts normally tensioned against said outer peripheral surface of said hot cylinder, whereby said warp and weft webs held in laminated relation are bonded together into an integral non-woven fabric structure free from widthwise shrinkage as they are passed around said hot cylinder.

2. The method of claim 1 wherein said warp web is a split web widthwise spread 1.1 to 5.0 times the original width.

3. The method of claim 1 wherein said warp web is a stretch tape, a reticulate web formed of trunk and branch filaments, a slit reticulate web formed of wide stretched film or a longitudinally stretched non-woven fabrics either alone or in combination.

4. The method of claim 1 wherein said weft web is a transversely stretched web of transversely parallel-laid weft fibers.

5. The method of claim 1 wherein said warp web or said weft web or both comprise an upper layer, a lower layer and a core interposed therebetween, said core having a higher melting or softening point than said upper and lower layers.

6. The method according to claim 1 wherein each of said endless belts is release-treated.

7. The method according to claim 1 wherein each of said endless belts is held in contact with at least one half of the overall circumference of said hot cylinder.

* * * * *